US005870925A

United States Patent [19]

Morris et al.

[11] Patent Number: 5,870,925

[45] Date of Patent: Feb. 16, 1999

[54] HAND TOOL CRIMPING A TERMINAL ONTO A CONDUCTOR

[75] Inventors: Michael Morris, Harrisburg; Richard Lloyd Schaeffer, Carlisle, both of Pa.

[73] Assignee: The Whitaker Corporation, Wilmington, Del.

[21] Appl. No.: 883,771

[22] Filed: Jun. 27, 1997

[51] Int. Cl.[6] ..... H01R 43/042

[52] U.S. Cl. ..... 72/409.12; 29/751; 81/313; 81/363

[58] Field of Search ..... 72/409.12, 409.14, 72/409.01, 456, 453.16; 81/313, 355, 362, 363; 29/751

[56] References Cited

U.S. PATENT DOCUMENTS

| | | | |
|---|---|---|---|
| 2,030,686 | 2/1936 | Davis | 72/453.16 |
| 2,704,001 | 3/1955 | Morse | 72/456 |
| 2,914,976 | 12/1959 | Demler | 72/409.12 |
| 3,322,008 | 5/1967 | Filia | 81/313 |
| 3,608,405 | 9/1971 | Schmidt | 81/362 |
| 3,611,782 | 10/1971 | Eppler | 29/715 |
| 3,903,725 | 9/1975 | Rommel | 29/751 |
| 4,126,936 | 11/1978 | Koller | 29/751 |
| 4,526,070 | 7/1985 | Wiener | 81/363 |
| 4,602,535 | 7/1986 | Wiener | 81/313 |
| 4,614,107 | 9/1986 | Norin | 72/402 |
| 4,829,805 | 5/1989 | Koehn | 72/410 |
| 5,012,666 | 5/1991 | Chen et al. | 72/410 |
| 5,042,286 | 8/1991 | Wiebe et al. | 72/414 |
| 5,168,743 | 12/1992 | Schrader et al. | 72/410 |
| 5,280,716 | 1/1994 | Ryan | 29/751 |
| 5,307,553 | 5/1994 | Frohlich | 29/566.2 |

*Primary Examiner*—Daniel C. Crane
*Attorney, Agent, or Firm*—Mary K. VanAtten

[57] ABSTRACT

A hand tool (10) is provided for crimping an electrical terminal onto a conductor. The tool includes a frame (12) having a fixed crimping tool (14) secured at one end and a movable crimping tool (16) arranged to slide along a linear path (20) within a guideway (48) in the frame (12) toward and away from the fixed crimping tool (14). A lever (18) is pivotally coupled to the movable crimping die (16) by a drive link (144) and three pivotal attachments (128, 146, 152). The drive link (144) includes a ratchet surface (188) in engagement with a pawl (196) pivotally attached to the lever (18) for compelling continued movement of the lever once a crimping operation has begun.

8 Claims, 3 Drawing Sheets

HAND TOOL CRIMPING A TERMINAL ONTO A CONDUCTOR

The present invention relates to a hand tool for crimping electrical terminal onto a conductor and more particularly to such a hand tool having a toggle action and linear movement of the crimping tooling.

BACKGROUND OF THE INVENTION

Hand operated crimping tools for crimping a terminal onto a conductor generally include a frame, a pair of pliers-like handles, and a mechanical linkage. A pair of mating crimping dies is included, one die being coupled to each handle so that upon operation of the handles the two dies are brought into mating engagement for effecting the desired crimped termination. Such a hand tool is disclosed in U.S. Pat. No. 4,829,805 which issued May 16, 1989 to Koehn. In some variations of this structure one of the handles is fixed to the frame so that, upon operation of the handles, only the die coupled to the other handle is pivoted into engagement with the die coupled to the frame. Such hand tools are disclosed in U.S. Pat. Nos. 5,307,553 which issued May 3, 1994 to Frohlich: 5,168,743 which issued Dec. 8, 1992 to Schrader et al.; 5,012,666 which issued May 7, 1991 to Chen et al.; and 4,614,107 which issued Sep. 30, 1986 to Norin. Typically, the mechanical linkage of these tools utilizes a drive link pivotally attached to the frame and the movable handle, with the handle being pivotally attached to a pivoting jaw which carries the movable die into engagement with a fixed die attached to the frame. A serrated surface on a side of the drive link engages a pawl pivotally attached to the movable handle for compelling full movement of the handle once the crimping operation is started. This linkage structure has the advantage of being simple to manufacture and maintain and is very effective and efficient to operate. However, such hand tools are limited to pivotal movement of the two mating dies during the crimping operation. This pivotal movement causes a slight rolling of the terminal as the mating dies crimp the terminal barrel causing distortion of the final crimped termination profile. Linear movement of the two mating dies is more desirable because this rolling action is not present. However, hand tools that utilize mechanisms that support linear movement of the mating crimping dies usually incorporate a C-shaped frame structure that is required to be relatively massive to prevent deflection during the crimping operation. See, for example, U.S. Pat. Nos. 3,322,008 which issued May 30, 1967 to Filia and 5,042,286 which issued Aug. 27, 1991 to Wiebe et al. Necessarily these structures utilize a linkage structure that is different, and frequently more complex, than the more desirable linkage structure of the pivoting hand tools mentioned above.

What is needed is a crimping hand tool that utilizes the toggle type actuating mechanism of the pivoting tools but moves the mating dies together along a linear path during the crimping operation, while providing a frame that is relatively small and light weight but sufficiently strong to prevent significant deflection during the crimping operation.

SUMMARY OF THE INVENTION

A tool is disclosed for crimping an electrical component onto a conductor to form a crimped connection. The tool includes a frame having a guideway, a fixed crimping tool secured to the frame, and a movable crimping tool arranged to slide along a linear path within the guideway in the frame in a first direction toward the fixed crimping tool and in a second opposite direction. A link is provided having a first end pivotally attached to the frame and a second end spaced therefrom. A handle having a free end includes an end opposite the free end that is pivotally attached to the movable crimping tool, and another end pivotally attached to the second end of the link at a point between the free end and the end opposite thereof. When the free end of the handle is moved toward the frame through a specific distance the movable crimping tool is moved in the first direction thereby effecting the crimping of the terminal. When the free end of the handle is moved away from the frame the movable crimping tool is moved in the second direction. A series of teeth is arranged to form a ratchet surface on the link. A pawl is pivotally attached to the handle and is arranged to engage the teeth of the ratchet surface upon movement of the free end toward the frame and, once so engaged, to compel the movement of the free end through the specific distance.

DESCRIPTION OF THE PREFERRED EMBODIMENT

Figure 4:
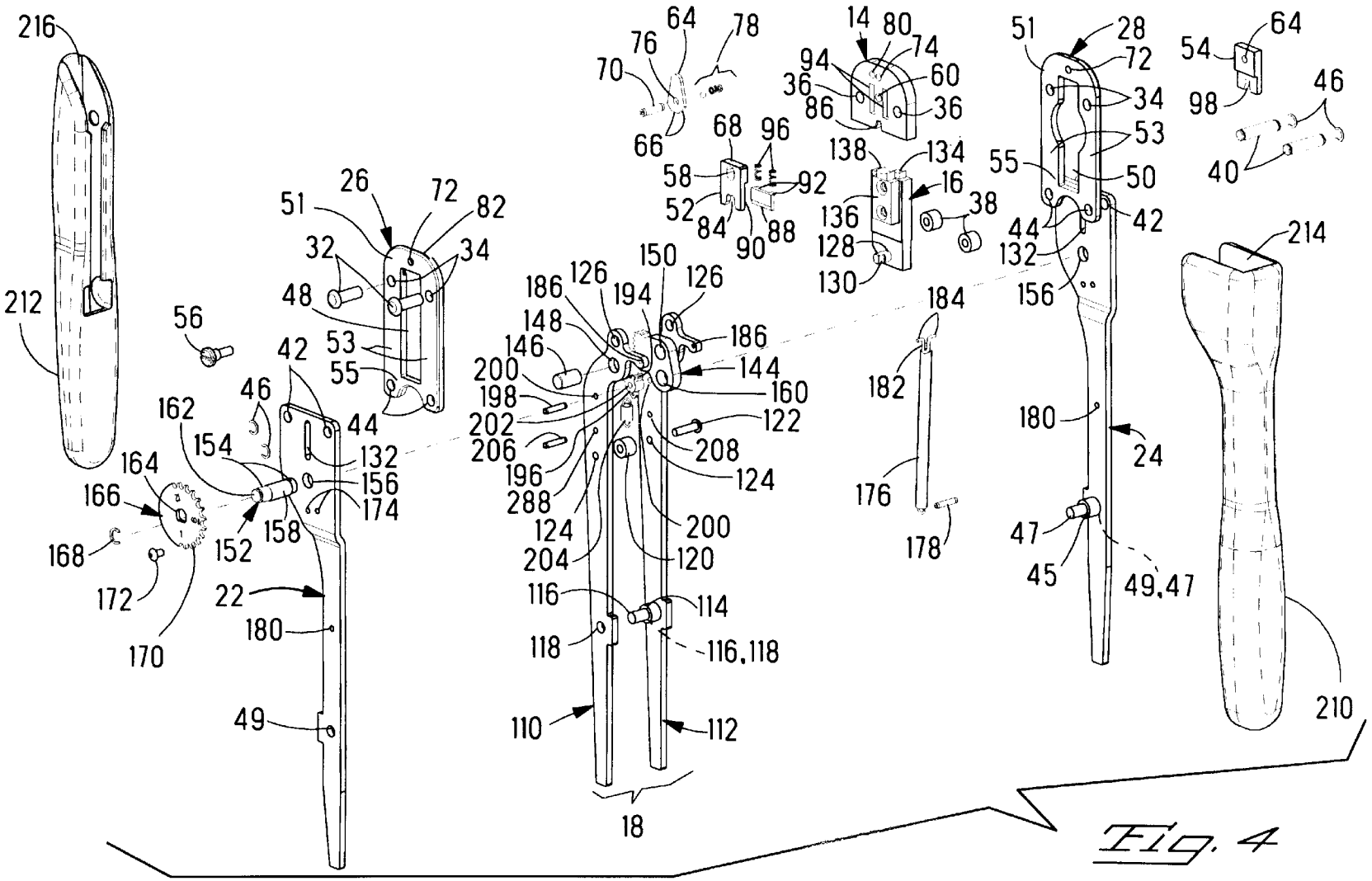
FIG. 4 is an exploded parts view of the tool shown in FIG. 1.

There is shown in FIGS. 1, 2, 3, and 4, a hand operated tool 10 for crimping a terminal onto a conductor. The tool 10 includes a frame 12, a fixed crimping die 14, a movable crimping die 16 that mates with the fixed die, and a lever 18 that is coupled to the frame and arranged to move the movable die along a linear path 20 toward and into crimping engagement with the fixed die. As best seen in FIG. 4, the frame 12 consists of left and right elongated members 22 and 24, respectively, and left and right head plates 26 and 28, respectively, which are secured together to form a single rigid unit, as will be explained. The fixed crimping die 14 is sandwiched between the left and right head plates 26 and 28 and the assembly secured together by means of two rivets 32 that extend through holes 34 formed through the two head plates and holes 36 formed through the fixed crimping die. The left and right head plates 26 and 28 are secured to the left and right elongated members 22 and 24 by means of two pins 40 which extend through two slip fit holes 42 formed through each of the elongated members and two slip fit holes 44 formed through each of the head plates. A pair of spacers 38 having a thickness similar to the thickness of the fixed crimping die 14 are disposed between the left and right head plates 26 and 28 so that the pins 40 extend therethrough. The two pins 40 are retained in place by means of spring retaining rings 46 that engage grooves formed in the ends of the pins 40 in the usual manner. A spacer 45 having a reduced diameter 47 on each end is arranged between the left and right elongated members 22 and 24 with the reduced diameters extending through holes 49 formed through the lower portions of the elongated members. The ends of the reduced diameters that extend past the elongated members are peened over to form a rigid attachment. The two rivets 32, two pins 40, and the peened spacer 45 combine to secure the left and right head plates and the left and right elongated members together into a rigid frame structure. The left head plate 26 includes an elongated opening 48 while the right head plate 28 includes a somewhat modified elongated opening 50, both of which have longitudinal axes that coincide with the linear path 20, as viewed in FIG. 2. The opening of each head plate defines a top potion 51, two side portions 53 and a bottom portion 55 that form a rigid structure. An insulation crimping die 52 is disposed within the upper portion of the opening 48 against the surface of the fixed die 14 and a similarly shaped terminal straightener 54 is disposed within the opening 50 against the opposite face of the fixed die, as shown in FIG. 4. A screw 56 extends through an elongated hole 58 formed through the die 52, a hole 60 formed through the fixed die 14, and into a threaded hole 64 in the terminal straightener 54. The elongated hole 58 permits a small amount of movement of the insulation crimping die 52 along the linear path 20 for adjustment purposes. Such adjustment is made by a lever 65 having several flat surfaces 66, each of which can engage a top surface 68 of the insulation crimping die 52 by pivoting the lever. The lever 65 is pivoted about a spring pin 70 which extends through holes 72 formed through the left and right head plates 26 and 28, a hole 74 formed through the fixed crimping die 14, and a hole 76 formed through the lever so that it is a different distance from each of the flat surfaces 66. The insulation crimp height of the tool is adjusted by pivoting the lever 64 so that a desired flat surface 66 is in engagement with the surface 68. A ball and spring assembly 78 extending from a hole 80 in the fixed crimping die 14, serves as a detent by engaging dimples, not shown, in the lever 65 thereby holding the lever in the selected position. A recess 82 is formed in the inwardly facing surface of the left head plate 26 to provide clearance for the lever 65. An insulation crimping die form 84 is formed in the downwardly facing end of the insulation crimping die 52 and a terminal crimping die form 86 is formed in the downwardly facing end of the fixed crimping die 14. A terminal locating member 88 is disposed within a cutout 90 of the insulation crimping die 52 and arranged to slide vertically between the die 52 and the adjacent wall of the fixed crimping die 14. A pair of tabs 92 extend from the member 88 into vertically disposed slots 94 formed in the fixed crimping die 14. A pair of springs 96 are arranged within the slots 94 to urge the locating member 88 downwardly into locating engagement with the terminal, in the usual manner. The terminal straightener 54 includes a locating form 98 that engages the terminal being crimped and holds it in position during the crimping operation.

Figures 1, 2, 3, 5:
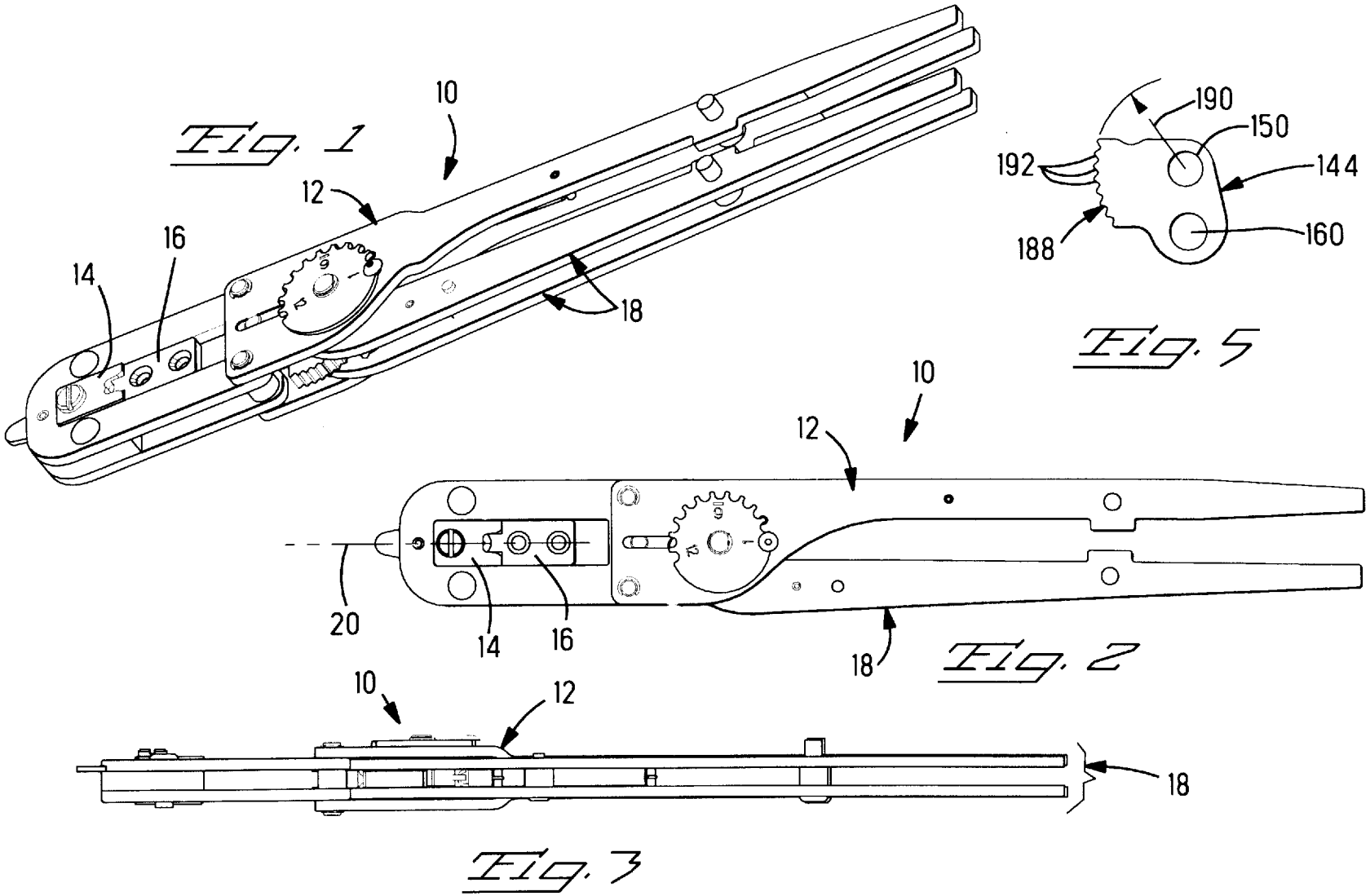
FIG. 1 is an isometric view of a crimping tool incorporating the teachings of the present invention.
FIGS. 2 and 3 are plan and side views, respectively, of the tool shown in FIG. 1.
FIG. 5 is a plan view of the drive link shown in FIG. 4.

The lever 18, as best seen in FIG. 4, is composed of left and right lever members 110 and 112, respectively, that are attached together by means of a spacer 114 having a reduced diameter 116 on each end. The reduced diameters extend through holes 118 formed through each lever member and are peened over to form a rigid attachment. Another spacer 120 is disposed near the upper end of and between the left and right lever members 110 and 112. A rivet 122 extends through holes 124 formed through the lever members and through the spacer 120 and is peened over in the usual manner. The rivet 122 and the spacer 114 secure the left and right lever members together to form a rigid lever 18. A hole 126 is formed through the upper most end of each of the left and right lever members 110 and 112 and are slip fits for a pin 128 that is pressed in a hole in and extends from opposite sides of the movable crimping die 16. The movable crimping die 16 is disposed between the left and right lever members and is pivotally coupled thereto by means of the pin 128. Each end of the pin 128 has a pair of parallel flats 130 that are slidingly received within a vertically disposed elongated hole 132 formed in the upper most ends of the left and right elongated members 22 and 24. The movable crimping die 16 has a crimping die form 134 in its upper surface that is in alignment and mates with the die form 86. A lower insulation crimping die 136 is rigidly attached to and carried by the movable crimping die 16 by any suitable means, and includes an insulation crimping die form 138 that is in alignment and mates with the die form 84 of the insulation crimping die 52. The width of the lower insulation crimping die 136 is chosen to be a sliding fit within the opening 48, which serves as a guideway, without appreciable side to side play so that the movable crimping die 16 and attached insulation crimping die 136 are free to slide along the linear path 20, shown in FIG. 2. A drive link 144 is disposed between the upper ends of the left and right lever members 110 and 112 and is pivotally attached thereto by means of a pin 146 that extends through a hole 148 formed through each of the left and right lever members and a hole 150 formed through the drive link. The drive link 144 is itself pivotally coupled to the left and right elongated members 22 and 24 by means of a pin 152. The pin 152 includes two in-line diameters 154 which are in slip fit engagement with holes 156 formed through the left and right elongated members, and an eccentric diameter 158 that is in slip fit engagement with a hole 160 formed through the drive link 144, as shown in FIG. 4. The left most end of the pin 152 includes a flat 162 formed thereon that is received in a conformal opening 164 in an adjusting wheel 166. A spring retaining ring 168 is received in a groove formed in the end of the pin to retain the wheel 166 in place. As the lower end of the lever 18 is moved away from and toward the frame 12, the upper end of the lever 18 and the drive link 144, which form a toggle, move the movable crimping die 16 away from and toward the fixed crimping die 14, respectively. By rotating the adjusting wheel 166 the pin 152 is rotated and the pivot point of the drive link is moved with respect to the frame 12, thereby altering the stroke of the movable crimping die 16. A series of scallops 170 are formed in the outer periphery of the wheel 166. A screw 172 is arranged in threaded engagement with one of a pair of threaded holes 174 formed in the left elongated member 22. The hole is positioned so that the screw also engages one of the scallops 170, thereby preventing rotation of the adjusting wheel without first removing the screw. A return extension spring 176 has one end attached to a pin 178 that extends between the left and right elongated members 22 and 24 and through holes 180 formed therein. The other end of the return spring is coupled to the upper end of the lever 18 by means of a U-shaped member 182 having a pair of outwardly formed ends 184 that extend through a hole 186 formed through an end of each of the left and right lever members 110 and 112. The holes 186 are positioned so that the return spring 176 urges the lower end of the lever 18 outwardly away from the frame 12, thereby urging the movable crimping die 16 in a direction away from the fixed crimping die 14. As best seen in FIG. 5, the drive link 144 includes an arcuate surface 188 which is a segment of a circle having a radius 190 that has its center at the center of the hole 150. A series of serrations 192 are formed on the surface 188 and are arranged to engage a tang 194 extending from a pawl 196, as best seen in FIG. 4. The pawl 196 is pivotally attached to the lever 18 by means of a pivot pin 198 that extends through holes 200 formed through the left and right lever members and a hole 202 formed through the pawl. A relatively short extension spring 204 has one end attached to the pawl 196 and the other end attached to a pin 206 that extend through holes 208 formed through the left and right lever members 110 and 112. The spring 204 tends to urge the pawl into a neutral position so that the tang 194 is normal to the serrated surface 188, however, the pin 198 is positioned so that the tang is in interfering engagement with the serrations 192 when the pawl is adjacent the surface 188. As will be explained, this operates to compel continued movement of the lower end of the lever 18 toward or away from the frame 12 once the tang has fully engaged one of the serrations. As best seen in FIG. 4, the tool 10 includes an optional pair of handles 210 and 212 that are made from rubber or plastic and shaped to be comfortable to an operator of the tool. The handle 210 includes a cavity 214 that is shaped to receive the lower ends of the left and right elongated members 22 and 24, while the handle 212 includes a cavity 216 that is shaped to receive the lower ends of the left and right lever members 110 and 112.

Figure 8:
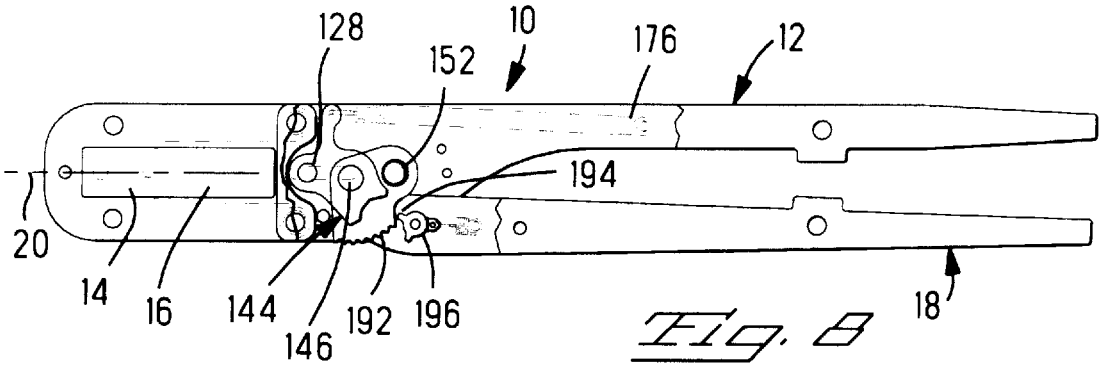
FIGS. 6, 7, and 8 are partial cutaway views of the tool shown in FIG. 2, showing the actuating mechanism of the tool in different operating positions.
Figure 7:
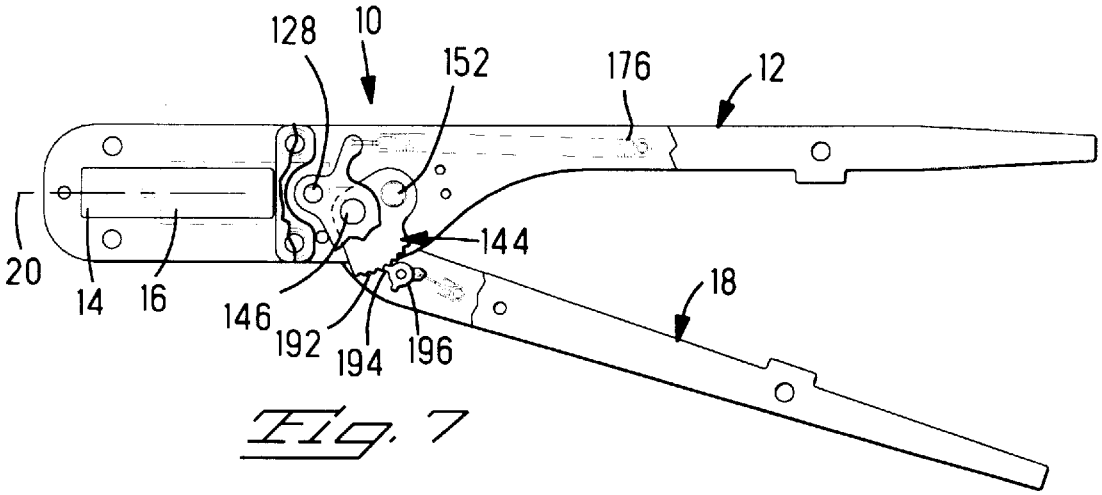
Figure 6:
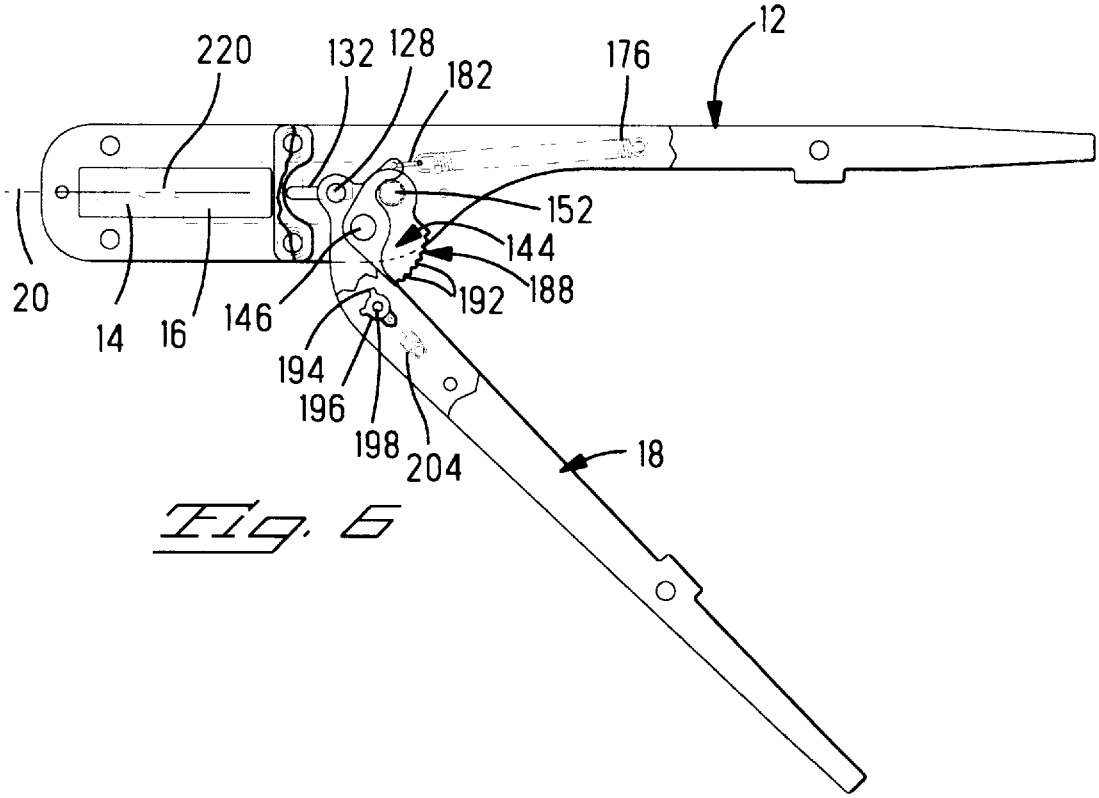

The operation of the tool 10 will now be described with reference to FIGS. 6, 7, and 8. The tool 10 is in its fully open position, as shown in FIG. 6, with the lever 18 pivoted away from the frame 12 as far as possible. A conductor having a terminal positioned thereon, not shown, is inserted into the opening 220 between the fixed and the movable crimping dies 14 and 16. The lever 18 is than manually moved toward the frame 12, in the usual manner, to begin the crimping operation. As this movement continues, the mechanism pivots about the pins 128, 146, and 152 so that the pin 128 moves toward the left, as viewed in FIG. 6, the flats 130 moving along the elongated holes 132 while the drive link 144 and the portion of the lever 18 between the pins 128 and 146 act as a toggle linkage. The tang 194 of the pawl 196 then engages the teeth 192 of the arcuate surface 188 causing the pawl to pivot counterclockwise, as shown in FIG. 7, the spring 204 retaining the tang in engagement with the teeth. The tang 194, being canted toward the left from a normal to the arcuate surface 188, as viewed in FIG. 7, prevents movement of the lever 18 in the opposite direction, away from the frame 12, until the lever 18 has been moved fully toward the frame to the position shown in FIG. 8. At this point the movable crimping die 16 has moved linearly along the linear path until the terminal and conductor are crimped between the fixed die form 86 and movable die form 134. The tang 194 has reached past the last tooth 192 on the arcuate surface 188 and the spring 204 has caused the pawl 196 to pivot clockwise to its neutral position. At this point the crimping operation is complete and the lever 18 is allowed to pivot away from the frame 12 under the urging of the spring 176. As the lever 18 moves away from the frame the pin 128 moves along the linear path 20 toward the pin 152 thereby moving the movable crimping die 16 away from the fixed crimping die 14 and the tang again engages the teeth 192 causing the pawl 196 to pivot further clockwise as the tang skips across the teeth. This pivotal movement of the lever 18 away from the frame 12 continues until the tool is in its fully open position, shown in FIG. 6. It will be appreciated by those skilled in the art that the lever 18 is pivotally attached to the drive link 144 at the same point as the center of radius of the arcuate surface 188, so that the pivot pin 198 of the pawl 196 maintains a fixed distance from the arcuate surface 188 as the lever 18 is moved with respect to the frame 12. This assures a simplified pawl and ratchet structure that supports the desired linear movement of the movable crimping die.

An important advantage of the present invention is that the closed structure of the frame 12 around the opening 220 assures a stronger yet light weight tool that will not appreciably deflect under the stress of the crimping operation, unlike the prior art C-shaped frame structures. Further, the movement of the movable die is linear movement, thereby eliminating any tendency of the terminal to roll during the crimping operation. Additionally, This linear movement is supported by a simplified pawl and ratchet structure.

We claim:

1. A tool for crimping an electrical component onto a conductor to form a crimped connection comprising:

a frame having a guideway;

a fixed crimping tool secured to said frame;

a movable crimping tool arranged to slide along a linear path within said guideway in said frame in a first direction toward said fixed crimping tool and in a second opposite direction;

a link having a first end pivotally attached to said frame and a second end spaced therefrom;

a lever having a free end, a second end opposite said free end pivotally attached to said movable crimping tool, and another end pivotally attached to said second end of said link at a point between said free end and said second end opposite thereof, said lever being arranged so that when said free end is moved toward said frame through a specific distance said movable crimping tool is moved in said first direction wherein said second end of said lever is slidably extendable along a path coincident with the linear path of said guideway thereby effecting said crimping of said terminal and when moved away from said frame said movable crimping tool is moved in said second direction;

a series of teeth arranged to form a ratchet surface on said link; and a pawl pivotally attached to said lever and arranged to engage said teeth of said ratchet surface upon movement of said free end toward said frame and, once so engaged, to compel said movement of said free end through said specific distance, and into and in guided relationship with said elongated hole in said frame.

2. The tool according to claim 1 wherein said ratchet surface is a portion of a circle having a center of radius at said pivotal attachment of said lever to said link.

3. The tool according to claim 2 wherein said pawl is arranged to move along an arc having a center of radius coincident with said center of radius of said ratchet surface when said free end of said lever is moved said specific distance.

4. The tool according to claim 1 wherein when said free end of said lever is moved toward said frame said specific distance said movable crimping tool and said fixed crimping tool are spaced apart a distance defining a shut height for said tool, and wherein said pivotal attachment of said link to said frame is effected by means of a pin in engagement with a hole in said frame and said pin having an eccentric diameter in engagement with a hole in said link, said pin arranged to be manually rotated for adjusting said shut height to a desired value.

5. The tool according to claim 1 including an elongated hole in said frame having a longitudinal axis parallel to said linear path and wherein said pivotal attachment of said second end of said lever to said movable crimping tool includes a pin extending through a hole in said lever, through a hole in said movable crimping tool, and into and in guided relationship with said elongated hole in said frame.

6. The tool according to claim 1 wherein said frame includes two spaced apart elongated members, each of which has a top portion attached to said fixed crimping tool, two side portions extending from said top portion on opposite sides of said linear path, and a bottom portion spaced from said top portion and attached to said two side portions, and wherein said movable crimping tool is arranged to slide along said linear path between said two elongated members.

7. The tool according to claim 6 wherein said two side portions of one of said elongated members form an opening between said top and bottom portions, said opening being said guideway and said movable crimping tool having a projection extending into said opening and in sliding engagement with said two side portions.

8. The tool according to claim 6 including spacers disposed between and rigidly attached to said two elongated members.

* * * * *